US009741300B2

(12) United States Patent
Amakawa et al.

(10) Patent No.: US 9,741,300 B2
(45) Date of Patent: Aug. 22, 2017

(54) LIQUID CRYSTAL APPARATUS

(71) Applicant: CITIZEN HOLDINGS CO., LTD., Nishitokyo-shi, Tokyo (JP)

(72) Inventors: Haruki Amakawa, Tokorozawa (JP); Shinya Kondoh, Nishitokyo (JP)

(73) Assignee: CITIZEN WATCH CO., LTD., Nishitokyo-shi, Tokyo (JP)

( * ) Notice: Subject to any disclaimer, the term of this patent is extended or adjusted under 35 U.S.C. 154(b) by 32 days.

(21) Appl. No.: 14/896,697

(22) PCT Filed: Jul. 11, 2014

(86) PCT No.: PCT/JP2014/068640

§ 371 (c)(1),
(2) Date: Dec. 8, 2015

(87) PCT Pub. No.: WO2015/005486

PCT Pub. Date: Jan. 15, 2015

(65) Prior Publication Data

US 2016/0148586 A1 May 26, 2016

(30) Foreign Application Priority Data

Jul. 11, 2013 (JP) ..... 2013-145475

(51) Int. Cl.
*G09G 3/36* (2006.01)

(52) U.S. Cl.
CPC ..... *G09G 3/3629* (2013.01); *G09G 2310/06* (2013.01); *G09G 2320/0252* (2013.01);
(Continued)

(58) Field of Classification Search
None
See application file for complete search history.

(56) References Cited

U.S. PATENT DOCUMENTS 6,717,561 B1 4/2004 Pfeiffer et al.
2003/0006950 A1 1/2003 Saishu et al.
2008/0309609 A1* 12/2008 Feng ..... G09G 3/3677 345/101

FOREIGN PATENT DOCUMENTS

JP 6-110037 A 4/1994
JP 2665331 B2 10/1997
(Continued)

OTHER PUBLICATIONS

International Search Report for PCT/JP2014/068640 dated Sep. 9, 2014 [PCT/ISA/210].
(Continued)

*Primary Examiner* — Kenneth B Lee, Jr.
(74) *Attorney, Agent, or Firm* — Sughrue Mion, PLLC

(57) ABSTRACT

A drive circuit has a ferroelectric liquid crystal panel that operates at a given switching angle and response speed, a sensor that measures temperature, a drive circuit that supplies driving voltage to the ferroelectric liquid crystal panel, a waveform generation circuit that supplies a waveform signal to the drive circuit, and a control circuit that controls the waveform generation circuit; and in a first frame of the driving voltage, outputs during a first interval, a first voltage that is positive and outputs during a second interval that is longer than the first interval, a second voltage that is positive, and in a second frame, outputs during the first interval, the first voltage that is negative and outputs during the second interval that is longer than the first interval, the second voltage that is negative. The control circuit varies the first voltage and the second voltage according to the measured temperature.

4 Claims, 13 Drawing Sheets

(52) U.S. Cl.
CPC ..... *G09G 2320/0285* (2013.01); *G09G 2320/041* (2013.01)

(56) References Cited

FOREIGN PATENT DOCUMENTS

| | | | |
|---|---|---|---|
| JP | 2000-66169 | A | 3/2000 |
| JP | 2002-328358 | A | 11/2002 |
| JP | 2003-5151 | A | 1/2003 |
| JP | 2003-270616 | A | 9/2003 |
| JP | 2008185979 | A | 8/2008 |
| JP | 2010145435 | A | 7/2010 |

OTHER PUBLICATIONS

Written Opinion for PCT/JP2014/068640 dated Sep. 9, 2014 [PCT/ISA/237].
International Preliminary Report on Patentability issued from the International Bureau in counterpart International Application No. PCT/JP2014/068640, mailed on Jan. 21, 2016.
Notification of Reasons for Refusal in corresponding Japanese Patent Application No. 2016-142579 dated Jun. 20, 2017.

* cited by examiner

FIG.3A

TEMPERATURE CHARACTERISTICS AND VOLTAGE CHARACTERISTICS OF RESPONSE SPEEDS S (TABLE 1-1)

| TEMPERATURE | 5V | 4V | 3V | 2.8V | 2.5V | 2.2V | 2V | 1.8V | 1.5V | 1.3V | 1V | 0.8V | 0.5V |
|---|---|---|---|---|---|---|---|---|---|---|---|---|---|
| 30 | 100 | 113 | 137 | 144 | 164 | 187 | 219 | 261 | | | | | |
| 40 | 70 | 81 | 96 | 103 | 115 | 135 | 155 | 202 | | | | | |
| 50 | 53 | 68 | 84 | 87 | 90 | 105 | 118 | 150 | 250 | | | | |
| 60 | 42 | 55 | 69 | 60 | 67 | 79 | 89 | 103 | 139 | 200 | | | |
| 80 | 29 | 32.8 | 41.6 | 43 | 47 | 52 | 56 | 60 | 70.6 | 80.2 | 101 | 130 | 228 |

30

TEMPERATURE CHARACTERISTICS AND VOLTAGE CHARACTERISTICS FOR SWITCHING ANGLE θ (TABLE 2-1)

| TEMPERATURE | 5V | 4V | 3V | 2.8V | 2.5V | 2.2V | 2V | 1.8V | 1.5V | 1.3V | 1V | 0.8V | 0.5V |
|---|---|---|---|---|---|---|---|---|---|---|---|---|---|
| 30 | 57 | 55 | 52.3 | 51.5 | 50.5 | 49.3 | 48 | 46 | 43.9 | 42 | 39 | 37 | 33 |
| 40 | 55 | 53.5 | 50.8 | 50 | 49 | 47.7 | 46.2 | 45.3 | 43 | 41 | 38 | 36 | 32 |
| 50 | 53 | 51.3 | 48.6 | 48 | 47 | 45.8 | 44.8 | 43.7 | 41.3 | 39.8 | 37.2 | 35 | 31.2 |
| 60 | 50 | 48.8 | 45.9 | 45.4 | 44.8 | 43.3 | 42.6 | 41.3 | 39.4 | 37.9 | 35.8 | 34 | 30.5 |
| 80 | 37 | 36.1 | 35 | 34.8 | 34.5 | 33.8 | 33.2 | 32.7 | 31.9 | 30.5 | 28.8 | 26.5 | 22.7 |

FIG.3B

TEMPERATURE CHARACTERISTICS AND VOLTAGE CHARACTERISTICS OF RESPONSE SPEEDS S (TABLE 1-2)

| TEMPERATURE | 5V | 4V | 3V | 2.8V | 2.5V | 2.2V | 2.0V | 1.8V | 1.5V | 1.3V | 1.0V | 0.8V | 0.5V |
|---|---|---|---|---|---|---|---|---|---|---|---|---|---|
| 30 | 392 | 571 | 680 | 712 | 756 | 816 | 842 | | | | | | |
| 40 | 168 | 210 | 280 | 316 | 352 | 382 | 474 | 574 | | | | | |
| 50 | 136 | 174 | 216 | 250 | 272 | 306 | 360 | 410 | 510 | | | | |
| 60 | 120 | 158 | 192 | 202 | 232 | 294 | 312 | 334 | 380 | 438 | | | |
| 80 | 82 | 94 | 116 | 124 | 132 | 144 | 152 | 172 | 188 | 200 | 240 | 266 | 402 |

TEMPERATURE CHARACTERISTICS AND VOLTAGE CHARACTERISTICS FOR SWITCHING ANGLE θ (TABLE 2-2)

| TEMPERATURE | 5V | 4V | 3V | 2.8V | 2.5V | 2.2V | 2.0V | 1.8V | 1.5V | 1.3V | 1.0V | 0.8V | 0.5V |
|---|---|---|---|---|---|---|---|---|---|---|---|---|---|
| 30 | 53.8 | 54.5 | 51.5 | 51.1 | 49.7 | 48.6 | 47.1 | 44.1 | 40.3 | 36.5 | | | |
| 40 | 53.9 | 53.4 | 51.6 | 50.3 | 50.2 | 48.5 | 46.2 | 46.2 | 44.5 | 42.1 | | | |
| 50 | 49.5 | 49.1 | 46.9 | 46.3 | 46 | 43.4 | 42.1 | 41.9 | 39.2 | 37.2 | 32.5 | | |
| 60 | 44.9 | 43.5 | 43.4 | 42.1 | 40.7 | 40.4 | 39.9 | 39 | 37.4 | 35 | 31.6 | 28.9 | |
| 80 | 25.7 | 25.4 | 24.9 | 24.1 | 23.5 | 24.4 | 24.7 | 24.6 | 24.8 | 24.3 | 23.2 | 20.9 | 16.8 |

(a-2)

(b-2)

TABLE T1

| TEMPERATURE (℃) | V1 | V2 |
|---|---|---|
| 30 | 3.7 | 1.7 |
| 40 | 2.4 | 1.8 |
| 50 | 2.0 | 2.0 |
| 60 | 1.7 | 2.6 |

(a-1)

TABLE T2

(b-1)

TABLE T1

| TEMPERATURE (℃) | V1 | V2 |
|---|---|---|
| 30 | 4.8 | 1.8 |
| 40 | 2.2 | 1.9 |
| 50 | 1.6 | 2.8 |
| 60 | 1.3 | 5 |

(a-2)

TABLE T2

(b-2)

LIQUID CRYSTAL APPARATUS

CROSS REFERENCE TO RELATED APPLICATIONS

This application is a National Stage of International Application No. PCT/JP2014/068640, filed on Jul. 11, 2014, which claims priority from Japanese Patent Application No. 2013-145475, filed on Jul. 11, 2013, the contents of all of which are incorporated herein by reference in their entirety.

TECHNICAL FIELD

The present invention relates to a liquid crystal apparatus having a liquid crystal panel that uses ferroelectric liquid crystal.

BACKGROUND ART

Recently, liquid crystal apparatuses employing a liquid crystal panel are used in various manufactured products such as, for example, flat screen televisions, mobile telephones, tablet terminals, and liquid crystal shutters. Although this liquid crystal panel employing a liquid crystal apparatus typically uses a nematic liquid crystal, the response speed is several msec or greater and this slow response speed often poses problems. In particular, when a liquid crystal panel is used as an optical shutter in, for example, a laser projector, high-speed response is required and commonly known liquid crystal panels (hereinafter, ferroelectric liquid crystal panel) use ferroelectric liquid crystal as a liquid crystal material that satisfies this requirement.

[Description of Ferroelectric Liquid Crystal Display Panel: FIG. 10]

Here, although common knowledge, an overview of the behavior of ferroelectric liquid crystal and architecture of a ferroelectric liquid crystal panel capable of high-speed response will be described to aid in the understanding of the present invention. While ferroelectric liquid crystals include materials that have memory properties and materials that have no memory properties, the liquid crystal panel of the liquid crystal apparatus described here is taken as an example of architecture using a material of ferroelectric liquid crystal having no memory properties.

A structure of a liquid crystal panel that employs ferroelectric liquid crystal will be described with reference to FIG. 10. In FIG. 10, (a) is a plan view schematically depicting configuration of polarizing film arrangement of a ferroelectric liquid crystal panel. As in (a) of FIG. 10, in a liquid crystal panel 100, a ferroelectric liquid crystal layer 102 (encompassed by broken line) is disposed in which, between polarizing films 101*a*, 101*b* according to crossed nicols, any one among a polarization axis C of the polarizing film 101*a* and a polarization axis D of the polarizing film 101*b* and, the molecular long axis direction during a first state (arrow E) or the molecular long axis during a second state (arrow F) of liquid crystal molecules are substantially parallel.

Here, in (a) of FIG. 10, the polarization axis C of the polarizing film 101*a* and the molecular long axis direction during the first state (arrow E) are arranged to be substantially parallel. Although transition between the first state and the second state of the molecular long axis direction of the ferroelectric liquid crystal occurs by an application of a given voltage to the ferroelectric liquid crystal, the angular difference (i.e., the angle between arrows E and F) of the molecular long axis direction during the first state and during the second state is defined as a switching angle θ. When the switching angle θ is 45 degrees, the contrast ratio of transmission and non-transmission is the greatest and therefore, a 45-degree switching angle θ is ideal for a ferroelectric liquid crystal panel.

In FIG. 10, (b) is a cross sectional view schematically depicting the structure of the liquid crystal panel 100. In (b) of FIG. 10, the liquid crystal panel 100 includes a pair of glass substrates 103*a*, 103*b* that hold therebetween the ferroelectric liquid crystal layer 102, which has the two states. Further, the glass substrates 103*a* and 103*b* are fixed by a sealing material 106. In opposing surfaces of the glass substrates 103*a*, 103*b*, plural scanning electrodes 104 and a signal electrode 105 are provided as a driving electrode that is a transparent electrode and on top of this, oriented films 107*a*, 107*b* are provided. Lt represents light transmitted by the liquid crystal panel 100.

On the outer side of the glass substrate 103*a*, as described above, the first polarizing film 101*a* is provided such that the molecular long axis direction of the first or the second state of the ferroelectric liquid crystal layer 102 is parallel; and on the outer side of the glass substrate 103*b*, the second polarizing film 101*b* is provided such that there is a 90 degree difference with the polarization axis of the first polarizing film 101*a*.

Operation of the liquid crystal panel 100 using ferroelectric liquid crystal will be described. When driving voltage VD applied to the liquid crystal panel 100 varies, optical transmissivity L of the light Lt (refer to (b) of FIG. 10) transmitted by the liquid crystal panel 100 varies. Here, switching of the ferroelectric liquid crystal, i.e., transition from one state to the other, occurs only when driving voltage of a value that is a cumulative value of a pulse width value and a pulse height value of the driving voltage VD, greater than or equal to a threshold is applied to the ferroelectric liquid crystal. Any one among the first state (non-transmission: black display) and the second state (transmission: white display) is selected for the liquid crystal panel 100 by the difference of polarity of the driving voltage VD.

The optical transmissivity L ratio of the first state (non-transmission: black display) and the second state (transmission: white display) is the contrast ratio described above, and the greatest contrast ratio is when the switching angle θ of the molecular long axis direction is 45 degrees.

Thus, when driving voltage greater than or equal to the threshold of the ferroelectric liquid crystal is applied, the second state is selected for the liquid crystal panel 100 and when driving voltage greater than or equal to the threshold of the reverse polarity of the ferroelectric liquid crystal is applied, the first state is selected.

As a result, as depicted in (a) of FIG. 10, with disposal of the polarizing films 101*a*, 101*b*, white display (transmission state) by the second state and black display (non-transmission state) by the first state is achieved. Black display (non-transmission state) by the second state and white display (transmission state) by the first state can be achieved by changing the arrangement of the polarizing films 101*a*, 101*b*.

Thus, a liquid crystal panel that uses ferroelectric liquid crystal can select between the non-transmission state and the transmission state (the two states that switch the long axis direction of the liquid crystal molecule), switching the polarity of the driving voltage VD between positive and negative. The speed of transition between these two states (i.e., response speed) is a high speed of a few tens of μsec to a few hundred μsec and thus, is suitable for liquid crystal panels that require a high-speed response and ferroelectric liquid crystal panels are used in display elements, liquid crystal shutters, etc. (for example, refer to Patent Document 1 below).

In Patent Document 1, a ferroelectric liquid crystal element is disclosed in which, in a first frame, a positive voltage pulse is applied during a first interval, which is a given period, and a positive voltage pulse that is smaller than the voltage pulse of the first interval is applied during a second interval that is a period longer than the first interval; and in a second frame, a negative voltage pulse is applied during the first interval that is a given period, and a negative voltage pulse that is smaller than the voltage pulse of the first interval is applied during the second interval that is a period longer than the first interval, the ferroelectric liquid crystal element adjusting the intensity of transmitted light to realize a high contrast ratio by changing the value of the applied voltage of the second interval of the first frame.

Patent Document 1: Japanese Patent No. 2665331 (page 3, FIG. 4)

DISCLOSURE OF INVENTION

Problem to be Solved by the Invention

Nonetheless, ferroelectric liquid crystal having the characteristic of high-speed response is temperature dependent and the response speed, which is the transition speed between states, has a characteristic of becoming slow when the temperature decreases and becoming fast when the temperature increases. Further, the switching angle θ of the molecular long axis direction increases when the temperature decreases and decreases when the temperature increases. Moreover, if the temperature is constant and the driving voltage to the ferroelectric liquid crystal made high, the response speed slows and the switching angle θ has a characteristic becoming large (details of the temperature characteristics and voltage characteristics of the ferroelectric liquid crystal will be described hereinafter).

Concerning performance generally required of a ferroelectric liquid crystal panel, the switching angle θ is required to be 45 degrees to maximize the contrast ratio as described above and the response speed is required to be as fast as possible.

However, for example, when the driving voltage is selected to obtain a 45-degree switching angle θ at a low temperature, a problem arises in that the switching angle θ becomes too small at high temperatures (refer to (b-1) of FIG. 4A or (b-2) of FIG. 4B). In other words, the contrast ratio at high temperatures decreases and consequently, performance as a liquid crystal panel decreases. Further, if the driving voltage is selected with consideration of the switching angle θ alone, the response speed at low temperatures becomes slow (refer to (a-1) of FIG. 4A or (a-2) of FIG. 4B). Conversely, if a high driving voltage is selected to make the response speed faster at low temperatures, a problem arises in that the switching angle at low temperatures becomes too large.

Thus, since the ferroelectric liquid crystal panel is temperature dependent, when used over a wide temperature range, both the required response speed and switching angle cannot be achieved and therefore, realization of a liquid crystal apparatus having a response speed and switching angle that satisfy required performance is difficult. Further, orientation stability of the ferroelectric liquid crystal is temperature dependent and particularly when a high driving voltage is applied, a problem arises in that orientation deformation occurs more easily in states of high temperature.

Here, the driving method of the ferroelectric liquid crystal display element disclosed in Patent Document 1 does not consider such temperature dependencies of ferroelectric liquid crystal and therefore, the response speed and switching angle fluctuate consequent to temperature changes, inviting graduated changes and drops in the contrast ratio as well as drops in the response speed and the possibility of a significant problem occurring in the display quality. In particular, when a wide operating temperature range is required, the temperature dependency of ferroelectric liquid crystal cannot be ignored and even when the temperature varies greatly, the response speed and switching angle need to achieve the required performance.

To solve the problems above, one object of the present invention is to provide a liquid crystal apparatus that includes a ferroelectric liquid crystal panel that operates having a response speed and switching angle that over the operating temperature range, achieve the required performance.

Means for Solving Problem

The present invention is characterized in that a liquid crystal apparatus having a liquid crystal panel that uses a ferroelectric liquid crystal, a drive circuit that supplies a driving voltage to the liquid crystal panel, a waveform generation circuit that supplies a waveform signal to the drive circuit, and a control circuit that controls the waveform generation circuit further includes a sensor that measures temperature, where the drive circuit, in a first frame of the driving voltage, outputs during a first interval, a first voltage that is positive and outputs during a second interval that is longer than the first interval, a second voltage that is positive; and in a second frame, outputs during the first interval, the first voltage that is negative and outputs during the second interval that is longer than the first interval, the second voltage that is negative. The control circuit varies the first voltage and the second voltage according to the temperature measured by the sensor.

In this case, preferably, the control circuit varies the first voltage according to the temperature measured by the sensor, such that a response speed of the liquid crystal panel is stable at a given value.

Preferably, the control circuit further varies the second voltage according to the measured temperature, such that a switching angle of the ferroelectric liquid crystal is stable at a given value.

Preferably, the control circuit generates from temperature characteristics of a response speed of the liquid crystal panel and of a switching angle of the ferroelectric liquid crystal, a table of the first voltage and the second voltage for obtaining a given response speed and switching angle, refers to the table according to the measured temperature, and determines the first voltage and the second voltage.

Preferably, the table is structured having values of the first voltage and the second voltage at a given temperature step, and in a temperature region lower than a temperature at which the first voltage and the second voltage determined by the table become equivalent, when the measured temperature is between temperature steps of the table, a voltage value of a temperature step on a low temperature side is selected as the first voltage, and a voltage that corresponds to the measured temperature is employed as the second voltage.

Preferably, the table is structured having values of the first voltage and the second voltage at a given temperature step, and in a temperature region higher than a temperature at which the first voltage and the second voltage determined by the table become equivalent, a voltage that corresponds to the measure temperature is employed as the second voltage and the first voltage is set to a voltage value equivalent to the second voltage.

A pulse width of the first interval of the first frame and the second frame, respectively, may be determined according to the response speed of the liquid crystal panel.

Effect of the Invention

According to the present invention, a liquid crystal apparatus can be provided that includes a ferroelectric liquid crystal panel that by respectively varying according to temperature, a first voltage and a second voltage of the driving voltage, achieves required performance with respect to temperature changes and has a high response speed and optimal switching angle. Further, a liquid crystal apparatus can be provided that by adjusting the driving voltage according to the required response speed and switching angle, does not apply high voltage exceeding that which is necessary and therefore, realizes uniform switching operation without unevenness and prevents the occurrence of orientation deformation.

BRIEF DESCRIPTION OF DRAWINGS

FIG. 3A is tables depicting one example of measurement data of temperature characteristics and voltage characteristics of a response speed and switching angle of the ferroelectric liquid crystal panel of the embodiment according to the present invention;

FIG. 3B is tables depicting another example of measurement data of the temperature characteristics and voltage characteristics of the response speed and switching angle of the ferroelectric liquid crystal panel of the embodiment according to the present invention;

BEST MODE(S) FOR CARRYING OUT THE INVENTION

Embodiments of the present invention will be described in detail with reference to the accompanying drawings.

Figure 1:
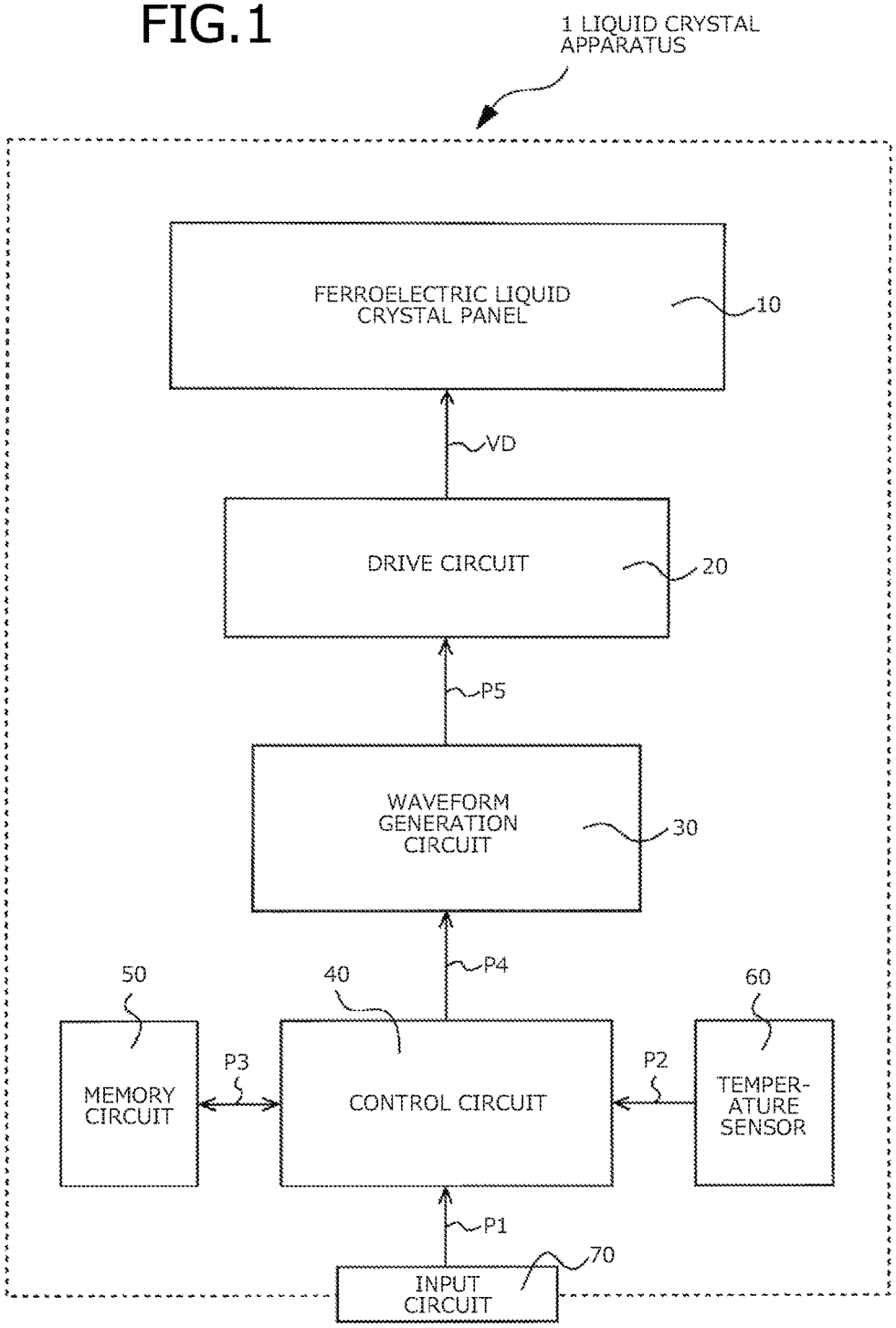
FIG. 1 is a block diagram of architecture of a liquid crystal apparatus of an embodiment according to the present invention.

[Description of Overall Architecture of Embodiment: FIG. 1]

An overview of overall architecture of a liquid crystal apparatus according to the present invention will be described with reference to FIG. 1. In FIG. 1, reference numeral 1 represents a liquid crystal apparatus according to the present invention. A liquid crystal apparatus 1 includes a ferroelectric liquid crystal panel 10, a drive circuit 20, a waveform generation circuit 30, a control circuit 40, a memory circuit 50, a temperature sensor 60, an input circuit 70, etc.

Figure 10:
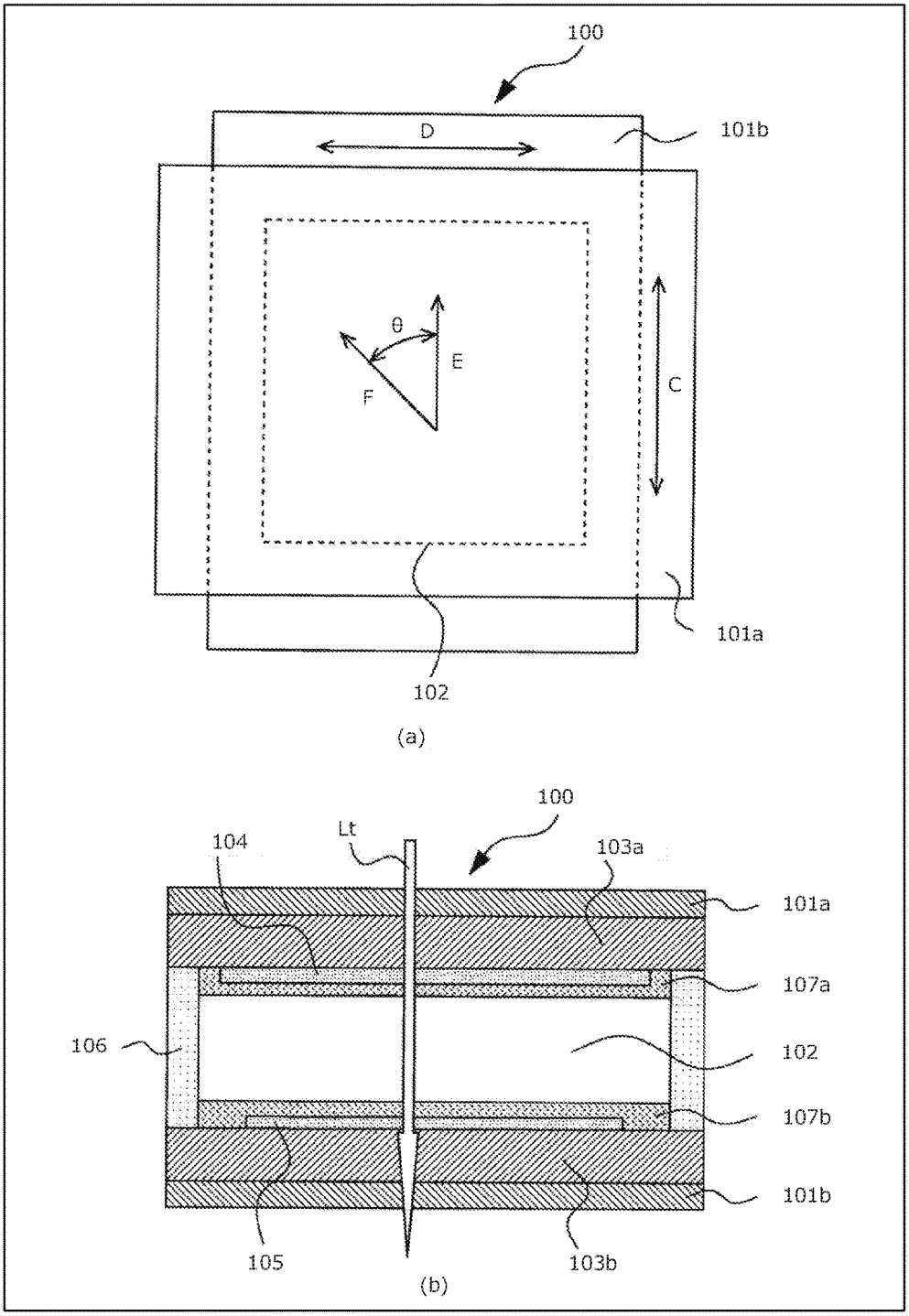
FIG. 10 is a diagram of architecture of a ferroelectric liquid crystal panel.

The ferroelectric liquid crystal panel 10 has the same architecture and operation as the liquid crystal panel 100 depicted in FIG. 10 and described above. Therefore, detailed description thereof will be omitted hereinafter. The drive circuit 20 outputs and supplies the driving voltage VD to the ferroelectric liquid crystal panel 10. The waveform generation circuit 30 outputs and supplies a waveform signal P5 to the drive circuit 20. The control circuit 40 receives and outputs an input signal P1 from the input circuit 70, a temperature signal P2 from the temperature sensor 60, and a memory signal P3 from the memory circuit 50, and supplies a control signal P4 to the waveform generation circuit 30.

The input circuit 70 receives display information, control information, etc. from an external apparatus (not depicted) and supplies the input signal P1 to the control circuit 40. The memory circuit 50 is configured by non-volatile memory and stores tables and the like for determining voltage values for the driving voltage, details will be described hereinafter. The temperature sensor 60 is configured by a semiconductor sensor, measures the ambient temperature, and outputs the temperature signal P2. Here, the drive circuit 20, the waveform generation circuit 30, the control circuit 40, the memory circuit 50, the input circuit 70, etc. may be configured by, for example, a single-chip microcomputer, a specifically customized IC, and the like.

Figure 2:
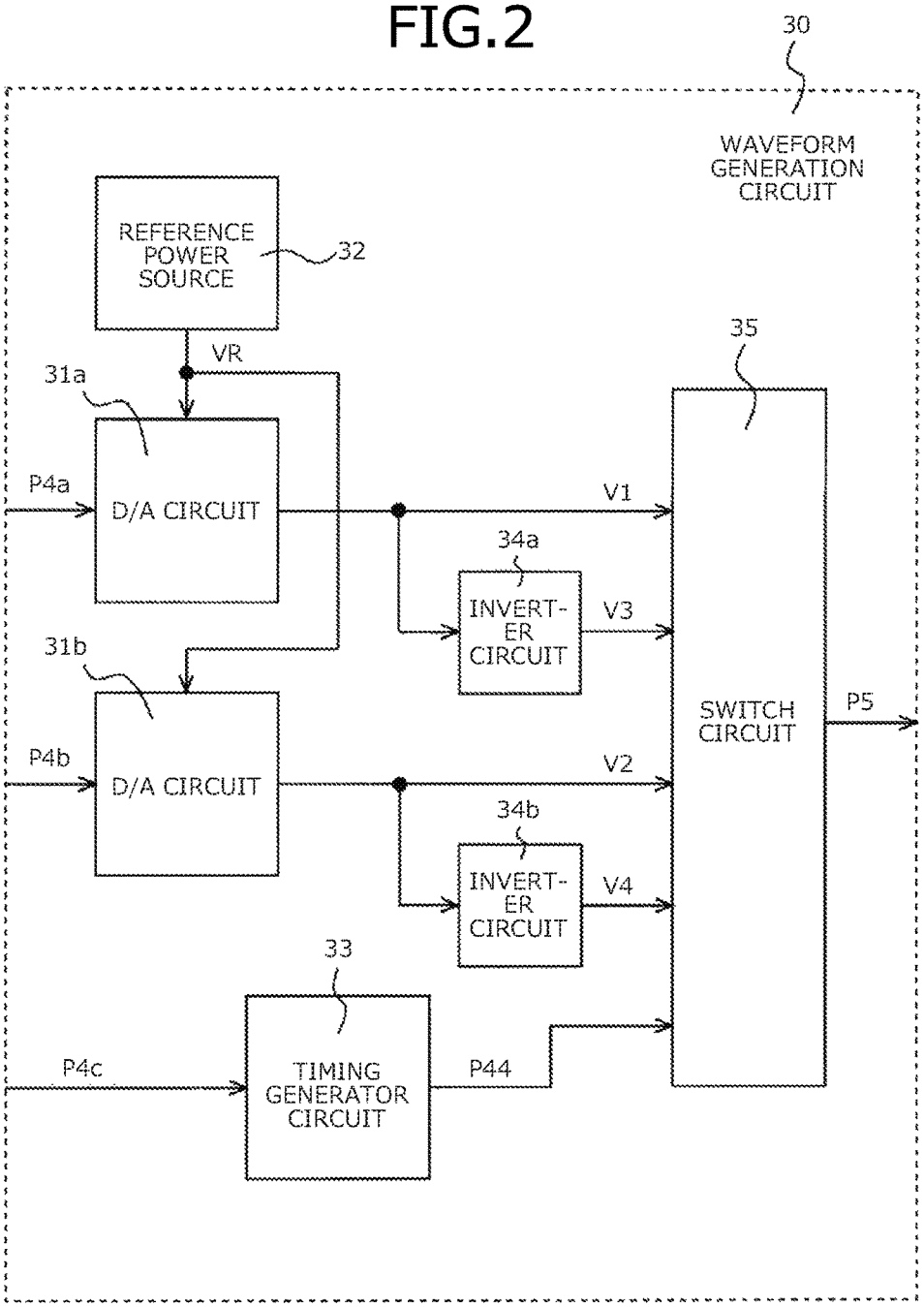
FIG. 2 is a block diagram of internal architecture of a waveform generation circuit of the liquid crystal apparatus of the embodiment according to the present invention.

[Description of Architecture of Waveform Generation Circuit: FIG. 2]

An overview of internal architecture of the waveform generation circuit 30, which is one component of the liquid crystal apparatus 1, will be described with reference to FIG. 2. In FIG. 2, the waveform generation circuit 30 is configured by two digital-to-analog converter circuits 31*a*, 31*b* (hereinafter, D/A circuits 31*a*, 31*b*), a reference power source 32, a timing generator circuit 33, two inverter circuits 34*a*, 34*b*, a switch circuit 35, etc.

The D/A circuit 31*a* receives a voltage control signal P4*a* that is of digital information and a part of the control signal P4, performs digital-to-analog conversion based on a given reference voltage VR from the reference power source 32, and outputs a positive voltage V1 that has been converted to an analog value. The voltage V1 is a positive first voltage V1 of the driving voltage VD described hereinafter. Further, the inverter circuit 34*a* receives the voltage V1, inverts the voltage polarity, and outputs a negative voltage V3. The voltage V3 is a negative first voltage V3 of the driving voltage VD described hereinafter.

Similarly, the D/A circuit 31*b* receives a voltage control signal P4*b* that is of digital information and a part of the control signal P4, performs digital-to-analog conversion based on the given reference voltage VR from the reference power source 32, and outputs a positive voltage V2. The voltage V2 is a positive second voltage V2 of the driving voltage VD described hereinafter. Further, the inverter circuit 34*b* receives the voltage V2, inverts the voltage polarity, and outputs a negative voltage V4. The voltage V4 is a negative second voltage V4 of the driving voltage described hereinafter.

The timing generator circuit 33 receives a timing control signal P4*c* that is of digital information and a part of the control signal P4 and outputs a timing signal P44 based on the timing control signal P4*c*. The timing signal P44 is a signal that determines the length of each interval of the driving voltage VD.

The switch circuit 35 receives the voltages V1 to V4 and the timing signal P44, switches the voltages V1 to V4 according to the timing signal P44, outputs and supplies the waveform signal P5 that is the source of the voltage waveform of the driving voltage VD, to the drive circuit 20 described above. The drive circuit 20 receives the waveform signal P5 and outputs the driving voltage VD of a low impedance output that drives the ferroelectric liquid crystal panel 10 (refer to FIG. 1).

[Description of Temperature Characteristics and Voltage Characteristics of Ferroelectric Liquid Crystal Panel: FIG. 3A, FIG. 3B, FIG. 4A, FIG. 4B]

An example of temperature characteristics and voltage characteristics for a response speed S and the switching angle θ of the ferroelectric liquid crystal panel 10 used by the liquid crystal apparatus of the present invention will be described with reference to FIG. 3A, FIG. 3B, FIG. 4A, and FIG. 4B.

FIG. 3A depicts characteristics in a case where the birefringence anisotropy (Δn) of the ferroelectric liquid crystal panel 10 is 0.247. FIG. 3B depicts characteristics in a case where the birefringence anisotropy of the ferroelectric liquid crystal panel 10 is 0.159. Birefringence anisotropy can increase the cell gap by using a small (e.g., 0.159) liquid crystal material and can facilitate improved yield rate.

Table 1-1 of FIG. 3A and Table 1-2 of FIG. 3B depict an example where in an environment of a temperature from 30° C. to 80° C., driving voltage of a rectangular waveform is applied within a range of ±0.5V to ±5V to the ferroelectric liquid crystal panel 10, and the response speed S (unit: μsec (μS)) is measured at 10° C. steps. 60° C. to 80° C. is a 20° C. step. Further, blanks in Table 1-1 and Table 1-2 indicate no measurements.

Further, Table 2-1 of FIG. 3A and Table 2-2 of FIG. 3B depict an example where in an environment of a temperature from 30° C. to 80° C., driving voltage of a rectangular waveform is applied within a range of ±0.5V to ±5V to the ferroelectric liquid crystal panel 10, and the switching angle θ (unit: degrees) is measured at 10° C. steps. 60° C. to 80° C. is a 20° C. step.

Figure 4A:
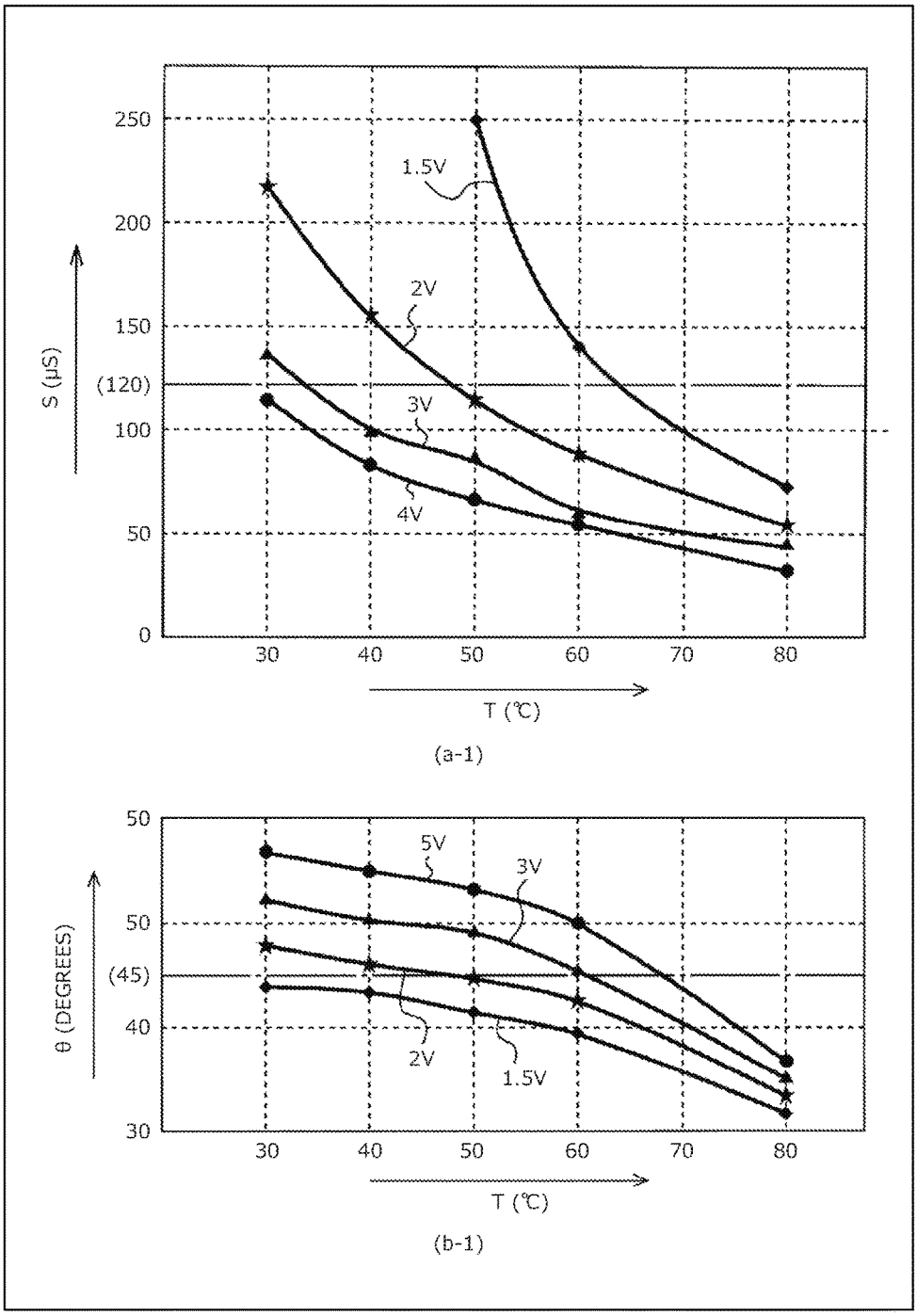
FIG. 4A is graphs depicting one example of temperature characteristics and voltage characteristics of the response speed and switching angle of the ferroelectric liquid crystal panel of the embodiment according to the present invention.

In FIG. 4A, (a-1) is a graph created by extracting the response speed S for driving voltages of 1.5V, 2V, 3V, and 4V to facilitate understanding of the temperature characteristics and voltage characteristics of the response speeds S in Table 1-1 of FIG. 3A. The horizontal axis represents T (° C.) and the vertical axis represents the response speed S (μsec).

Figure 4B:
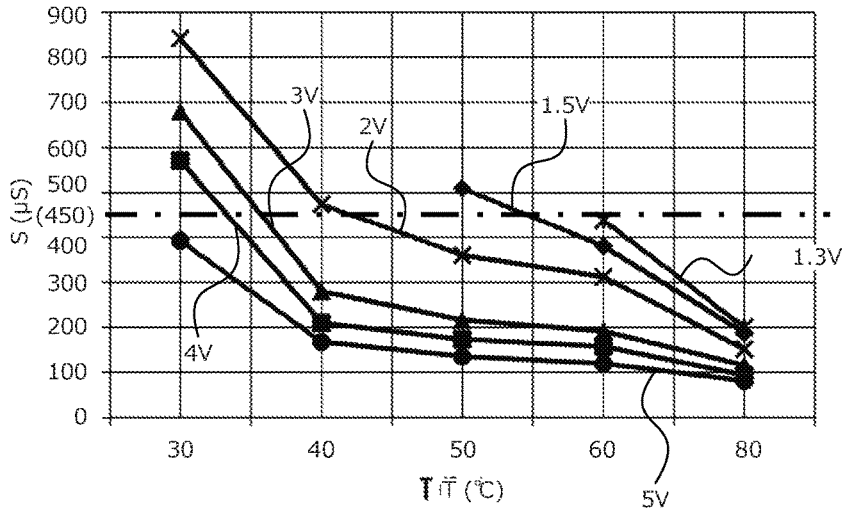
FIG. 4B is graphs depicting another example of temperature characteristics and voltage characteristics of the response speed and switching angle of the ferroelectric liquid crystal panel of the embodiment according to the present invention.
Figure 4B:
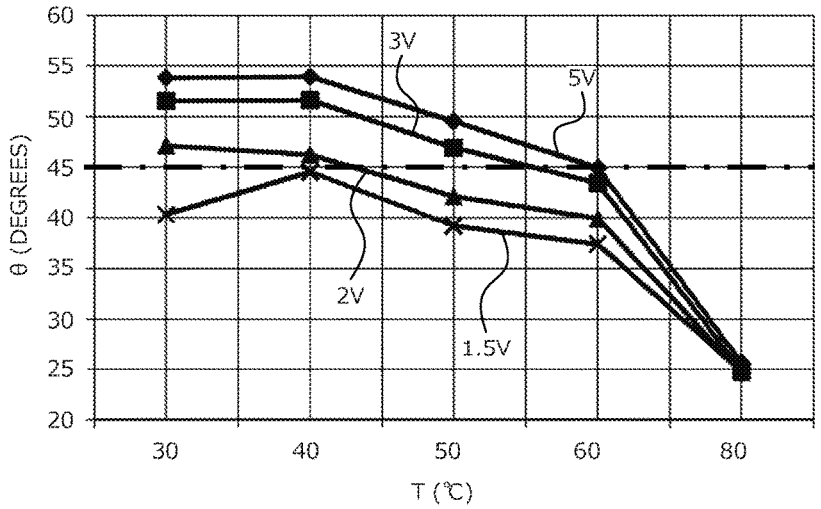

In FIG. 4B, (a-2) is a graph created by extracting the response speed S for driving voltages of 1.3V, 1.5V, 2V, 3V, 4V, and 5V to facilitate understanding of the temperature characteristics and voltage characteristics of the response speeds S in Table 1-2 of FIG. 3B. The horizontal axis represents T (° C.) and the vertical axis represents the response speed S (μsec).

As can be understood from (a-1) in FIG. 4A and (a-2) in FIG. 4B, the response speed S has temperature characteristics of becoming faster when the temperature rises and voltage characteristics of becoming slower when the driving voltage decreases.

In FIGS. 4A and 4B, respectively, (b-1) and (b-2) are graphs respectively created by extracting the switching angle θ for driving voltages of 1.5V, 2V, 3V, and 5V to facilitate understanding of the temperature characteristics and voltage characteristics of the switching angles θ in Table 2-1 of FIG. 3A and in Table 2-2 of FIG. 3B. The horizontal axis represents T (° C.) and the vertical axis represents the switching angle θ (degrees). As can be understood from (b-1) and (b-2) in FIGS. 4A and 4B, the switching angle θ has temperature characteristics of decreasing when the temperature rises and voltage characteristics of increasing when the driving voltage increases.

Further, as described above, although the contrast ratio is maximized when the switching angle θ=45 degrees, as can be clearly understood from this graph, the switching angle θ deviates from 45 degrees when the voltage value of the driving voltage is too high and when too low.

Accordingly, the switching angle θ has an optimal driving voltage for a given temperature.

Figure 5:
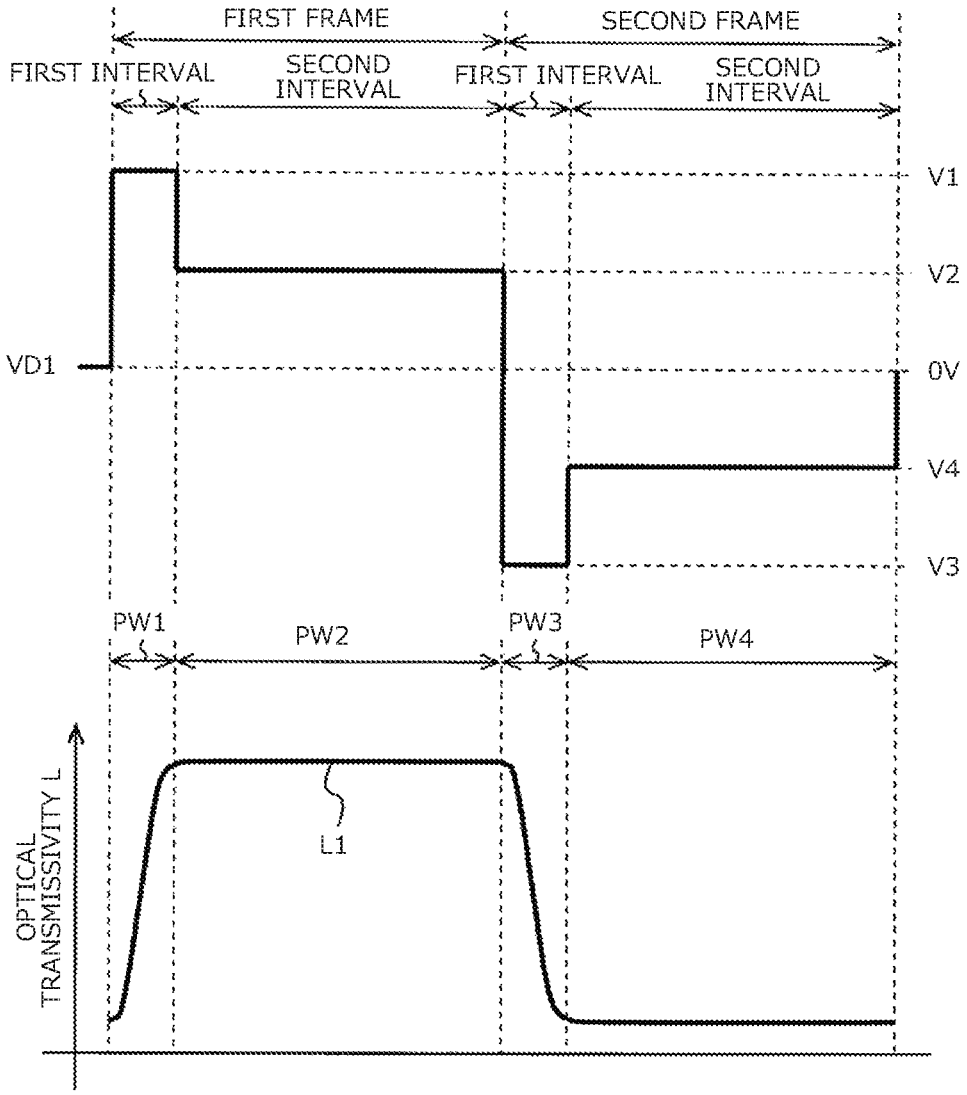
FIG. 5 is a diagram describing an example of a driving voltage VD1 for a cross temperature of the embodiment according to the present invention or lower, and an example of optical transmissivity of the ferroelectric liquid crystal panel by the driving voltage.

[Description of Voltage Waveform of Driving Voltage VD: FIG. 5]

An example of a voltage waveform of the driving voltage VD that drives the ferroelectric liquid crystal panel 10 of the present embodiment will be described with reference to FIG. 5. The driving voltage depicted in FIG. 5 is described as driving voltage VD1 to distinguish this driving voltage from driving voltage (VD2) of a high-temperature region described hereinafter. In FIG. 5, the driving voltage VD1 is configured by two frames, a first frame in which positive voltage is applied and a second frame in which negative voltage is applied. The first frame includes a first interval during which the positive first voltage V1 is applied and a second interval during which the positive second voltage V2 is applied, the second interval being an interval that is longer than the first interval.

Further, the second frame is includes a first interval during which the negative first voltage V3 is applied and a second interval during which the negative second voltage V4 is applied, the second interval being an interval that is longer than the first interval. The absolute values of the first voltage V1 of the first frame and of the first voltage V3 of the second frame are set equivalently, and the absolute values of the second voltage V2 of the first frame and of the second voltage V4 of the second frame are set equivalently.

The first interval of the first frame is defined as pulse width PW1 and the second interval of the first frame is defined as pulse width PW2. Further, the first interval of the second frame is defined as pulse width PW3 and the second interval of the second frame is defined as pulse width PW4. The respective pulse widths are set to be PW1<PW2, PW3<PW4, PW1=PW3, PW2=PW4. Thus, the voltage and pulse width of the first frame and second frame are set whereby, the ferroelectric liquid crystal panel 10 is driven by alternating current without application of a direct current component.

The voltage values of the positive first voltage V1 (hereinafter, the first voltage V1) of the first interval of the first frame and the negative first voltage V3 (hereinafter, the first voltage V3) of the first interval of the second frame of the driving voltage VD1 can be varied according to temperature and further, the voltage values of the positive second voltage V2 (hereinafter, the second voltage V2) of the second interval of the first frame and the negative second voltage V4 (hereinafter, the second voltage V4) of the second interval of the second frame can be varied according to temperature whereby, characteristics of both the response speed S and the switching angle θ of the ferroelectric liquid crystal panel 10 can be maintained substantially constant with respect to temperature fluctuations and in keeping with required performance, a significant feature of the present invention.

More specifically, the ability to vary the first voltage V1 and the first voltage V3 according to temperature allows control to be performed such that over the operating temperature range, the response speed S of the ferroelectric liquid crystal panel 10 achieves required performance stably. Further, the ability to vary the second voltage V2 and the second voltage V4 according to temperature allows control to be performed such that over the operating temperature range, the switching angle θ of the ferroelectric liquid crystal panel 10 achieves required performance stably. Control to vary the first voltages V1, V3, and the second voltages V2, V4 of the driving voltage VD1 is implemented by the control circuit 40 described hereinafter controlling the waveform generation circuit 30.

[Description of Operation of Ferroelectric Liquid Crystal Panel by Driving Voltage VD1: FIG. 5]

Operation of the ferroelectric liquid crystal panel 10 by the driving voltage VD1 will be described with reference to FIG. 5. Here, description will be given assuming that the ferroelectric liquid crystal panel 10 according to the present embodiment has the same characteristics as the liquid crystal panel 100 depicted in FIG. 10 and described above. The optical transmissivity L1 in FIG. 5 represents the transition of the optical transmissivity of the light Lt (refer to (b) of FIG. 10) transmitted by the ferroelectric liquid crystal panel 10 when the driving voltage VD1 is applied to the ferroelectric liquid crystal panel 10.

In FIG. 5, when the first voltage V1 is applied to the ferroelectric liquid crystal panel 10 during the first interval of the first frame, the ferroelectric liquid crystal panel 10 enters the second state (transmission state by long axis direction F of liquid crystal molecules (refer to (a) of FIG. 10)) and the optical transmissivity L1 rises. The slope of the rising curve at this time determines the response speed S of the ferroelectric liquid crystal. At the subsequent second interval, the positive second voltage V2 of a low voltage value is applied, however, since the long axis direction F of the liquid crystal molecules is maintained, the second state (transmission state) continues and the high state of the optical transmissivity L1 continues.

Next, at the first interval of the second frame, the negative first voltage V3 is applied and consequently, the ferroelectric liquid crystal panel 10 enters the first state (non-transmission state by long axis direction E of liquid crystal molecules (refer to (a) of FIG. 10)) and the optical transmissivity L1 rapidly drops. The slope of the descending curve at this time determines the response speed S of the ferroelectric liquid crystal. At the subsequent second interval, the negative second voltage V4 of a low voltage value is applied, however, since the long axis direction E of the liquid crystal molecules is maintained, the first state (non-transmission state) continues and the low state of the optical transmissivity L1 continues.

Figure 6:
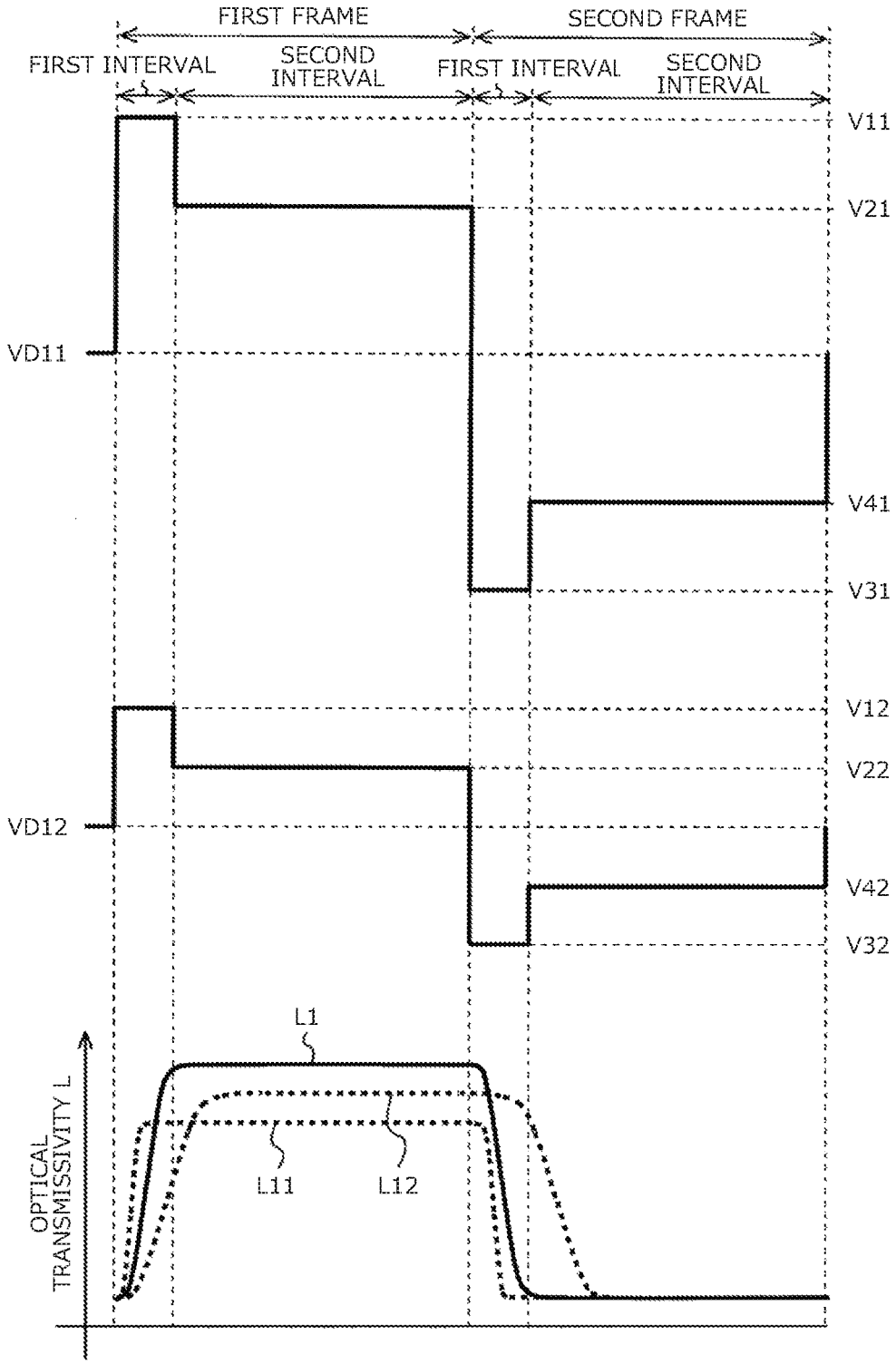
FIG. 6 is a diagram describing variation of the optical transmissivity of the ferroelectric liquid crystal panel consequent to the driving voltage applied to the ferroelectric liquid crystal panel of the embodiment according to the present invention.

[Description of Operation of Ferroelectric Liquid Crystal Panel by Varying Driving Voltage VD1: FIG. 6]

Operational changes of the ferroelectric liquid crystal panel 10 accompanying changes in the voltage value of the driving voltage VD1 will be described with reference to FIG. 6. In FIG. 6, a driving voltage VD11 is configured by first voltages V11, V31 and second voltages V21, V41, each of which has a voltage value that is higher than the driving voltage VD1 described above (refer to FIG. 5). Further, the driving voltage VD12 is configured by first voltages V12, V32 and second voltages V22, V42, each of which has a voltage value that is lower than the driving voltage VD1 described above.

In FIG. 6, the optical transmissivity L11 is one example of transition of the optical transmissivity of the ferroelectric liquid crystal panel 10 when the driving voltage VD11 is applied and the optical transmissivity L12 is one example of transition of the optical transmissivity of the ferroelectric liquid crystal panel 10 when the driving voltage VD12 is applied. Further, the optical transmissivity L1 is one example of transition of the optical transmissivity of the ferroelectric liquid crystal panel 10 consequent to the driving voltage VD1 described above (refer to FIG. 5).

Here, as depicted, the slope of the rising edge and falling edge in the first intervals is greater for the optical transmissivity L11 consequent to the application of the driving voltage VD11 than for the optical transmissivity L1. This is consequent to the response speed S of the ferroelectric liquid crystal becoming faster, as indicated by the graphs of (a-1) and (a-2) in FIGS. 4A and 4B, since the first voltages V11, V31 of the driving voltage VD11 are higher than the first voltages V1, V3 of the driving voltage VD1.

Further, since the second voltage V21 of the driving voltage VD11 is higher than the second voltage V2 of the driving voltage VD1, the switching angle θ of the ferroelectric liquid crystal becomes too large relative to 45 degrees and the optical transmissivity drops as indicated by the graphs of (b-1) and (b-2) in FIGS. 4A and 4B, whereby the size of the second interval of the optical transmissivity L11 becomes smaller than that of the optical transmissivity L1.

As depicted, the slope of the rising edge and falling edge of the first intervals is smaller for the optical transmissivity L12 consequent to application of the driving voltage VD12 than for the optical transmissivity L1. This is consequent to the response speed S of the ferroelectric liquid crystal becoming slower as indicated by the graphs of (a-1) and (a-2) in FIGS. 4A and 4B, since the first voltages V12, V32 of the driving voltage VD12 are lower than the first voltages V1, V3 of the driving voltage VD1.

Further, since the second voltage V22 of the driving voltage VD12 is lower than the second voltage V2 of the driving voltage VD1, the switching angle θ of the ferroelectric liquid crystal becomes to small relative to 45 degrees and the optical transmissivity drops as indicated by the graphs of (a-1) and (a-2) in FIGS. 4A and 4B, whereby the size of the second interval of the optical transmissivity L12 becomes smaller than that of the optical transmissivity L1.

Thus, the first voltages V1, V3 of the head first interval of the first frame and the second frame of the driving voltage VD1 greatly affect the response speed S of the ferroelectric liquid crystal panel 10 and therefore, by enabling the first voltages V1, V3 to be varied, the response speed S can be adjusted. Further, the second voltages V2, V4 of the second interval after the first interval of the first frame and the second frame of the driving voltage VD1 greatly affect the switching angle θ of the ferroelectric liquid crystal panel 10 and therefore, by enabling the second voltages V2, V4 to be varied, the switching angle θ can be optimally adjusted, enabling the optical transmissivity L to be increased (i.e., enabling the contrast ratio to be increased).

The response speed S and the switching angle θ of the ferroelectric liquid crystal panel 10 has voltage characteristics such as those above and the liquid crystal apparatus of the present invention uses the voltage characteristics of such a ferroelectric liquid crystal panel as the ferroelectric liquid crystal panel 10 and, by enabling the first voltages V1, V3 of the driving voltage VD1 to be varied, can correct the temperature characteristics of the response speed S and by enabling the second voltages V2, V4 of the driving voltage VD1 to be varied, can correct the temperature characteristics of the switching angle θ.

Figure 7:
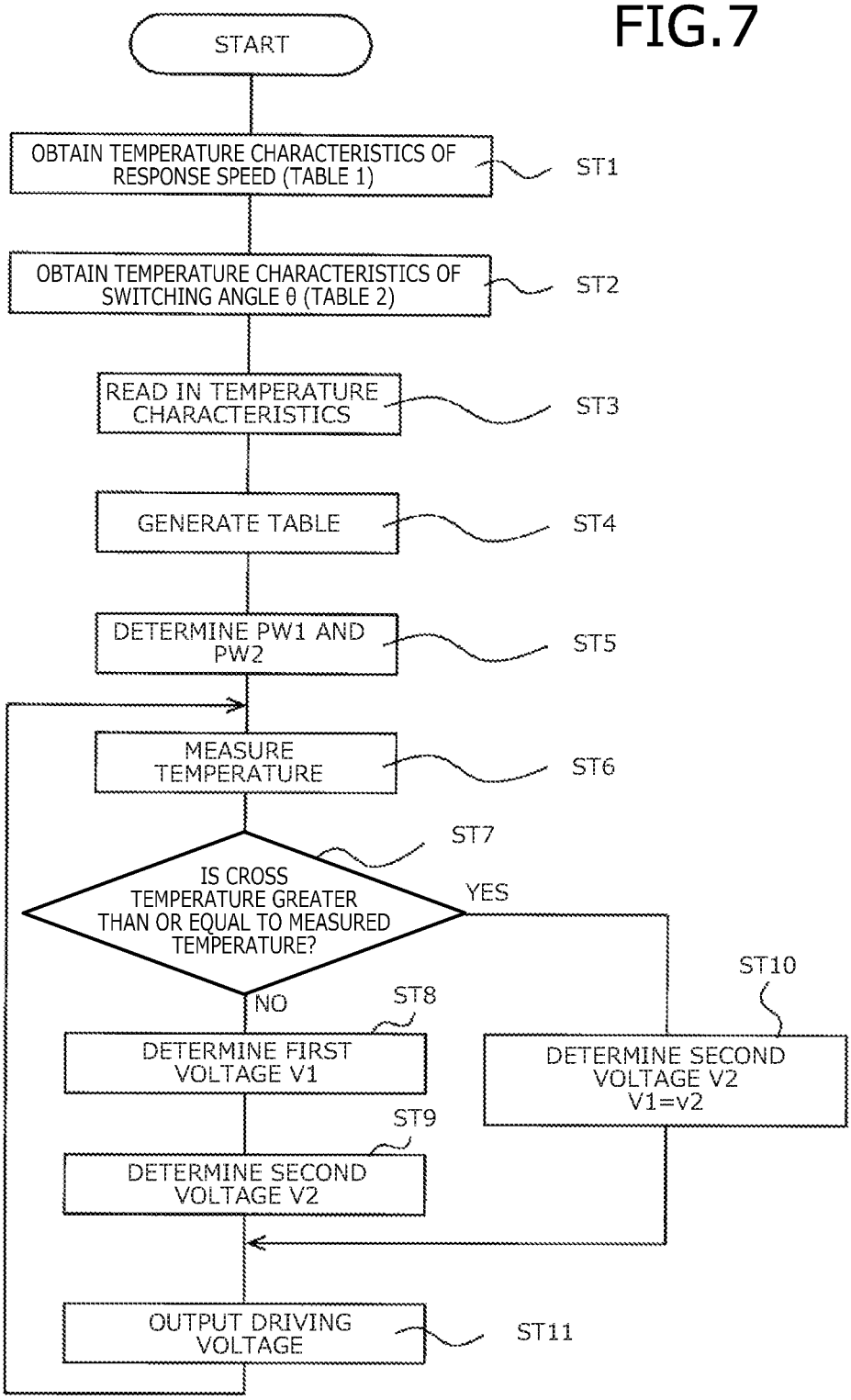
FIG. 7 is a flowchart of operation of the embodiment according to the present invention.

[Description of Operation Flow of Embodiment: FIG. 7]

An operation example of an embodiment of the liquid crystal apparatus according to the present invention will be described with reference to the flowchart in FIG. 7. For architecture of the embodiment refer to FIGS. 1 and 2. In FIG. 7, temperature characteristics of the response speed S of the ferroelectric liquid crystal panel 10 are obtained (step ST1). For instance, as one example, in an environment of a temperature from 30° C. to 80° C., driving voltage of a rectangular waveform is applied within a range of ±0.5V to ±5V to the ferroelectric liquid crystal panel 10, and the response speed S is measured at 10° C. steps. One example of measurement data at step ST1 is the temperature characteristics (Table 1-1, Table 1-2) depicted in FIGS. 3A, 3B and described above for the response speed S. 60° C. to 80° C. is a 20° C. step.

In the flowchart depicted in FIG. 7, temperature characteristics of the switching angle θ of the ferroelectric liquid crystal panel 10 are obtained (step ST2). For instance, as one example, in an environment of a temperature from 30° C. to 80° C., driving voltage of a rectangular waveform is applied within a range of ±0.5V to ±5V to the ferroelectric liquid crystal panel 10, and the switching angle θ is measured at 10° C. steps. One example of measurement data at step ST2 is the temperature characteristics (Table 2-1, Table 2-2) depicted in FIG. 3A, FIG. 3B and described above for the switching angle θ. 60° C. to 80° C. is a 20° C. step.

In the present example, the obtaining of the temperature characteristics of the ferroelectric liquid crystal panel 10 (ST1 and ST2) need not be performed internally by the liquid crystal apparatus 1 and suffices to be by connection of the ferroelectric liquid crystal panel 10 to an external measuring apparatus though not depicted.

Next in the flowchart depicted in FIG. 7, the control circuit 40 of the liquid crystal apparatus 1 reads in via the input circuit 70 and stores to the memory circuit 50, measurement data of the temperature characteristics (Table 1-1 in FIG. 3A or Table 1-2 in FIG. 3B) of the response speed S and the temperature characteristics (Table 2-1 in FIG. 3A or Table 2-2 in FIG. 3B) of the switching angle θ of the ferroelectric liquid crystal panel 10, obtained through the external measuring apparatus (not depicted) (step ST3).

Next, the control circuit 40 of the liquid crystal apparatus 1 generates by computation from the stored data of the temperature characteristics of the response speed S and switching angle θ, a table of the first voltages V1, V3 and the second voltages V2, V4 of the driving voltage for obtaining the required response speed S and switching angle θ over the operating temperature range and stores the tables to the memory circuit 50 (step ST4). Detailed description of table generation will be given hereinafter.

The control circuit 40 of the liquid crystal apparatus 1 determines the pulse width PW1 for the first interval and the pulse width PW2 for the second interval from the response speed S (step ST5). Detailed description of determination of the pulse width PW1 for the first interval and the pulse width PW2 for the second interval will be described hereinafter.

The control circuit 40 of the liquid crystal apparatus 1 receives the temperature signal P2 from the temperature sensor 60 (refer to FIG. 1), measures and stores to the memory circuit 50, the temperature of the environment in which the liquid crystal apparatus 1 is placed (step ST6).

The control circuit 40 of the liquid crystal apparatus 1, from the table generated at step ST4, stores as a cross temperature Tcp, the temperature at which the voltage value of the first voltage V1 and the voltage value of the second voltage V2 cross, and determines if the cross temperature Tcp is greater than or equal to the measured temperature obtained at the step ST6 (ST7). Here, if the determination is negative (less than Tcp), the control circuit 40 proceeds to step ST8; and if the determination is positive (greater than or equal to Tcp), the control circuit 40 proceeds to step ST10.

At step ST7, if a negative determination is made, the control circuit 40 of the liquid crystal apparatus 1 determines the first voltage V1 from the table (step ST8). The control circuit 40 of the liquid crystal apparatus 1 determines the second voltage V2 from the table and proceeds to step ST11 (step ST9). Detailed description of determination concerning the cross temperature Tcp (ST7), and determination of the first voltage V1 and the second voltage V2 (ST8, ST9) will be given hereinafter.

At step ST7, if a positive determination is made, the control circuit 40 of the liquid crystal apparatus 1 determines the second voltage V2 from the table and further sets the first voltage V1=the second voltage V2, and proceeds to step ST11 (step ST10). Detailed description of determination of the second voltage V2 (ST10) will be given hereinafter.

The control circuit 40 of the liquid crystal apparatus 1 outputs as the control signal P4, digital information of PW1, PW2, V1, and V2, which are parameters of the determined driving voltage VD; and the waveform generation circuit 30 receives the control signal P4, internally generates the voltage waveform of the driving voltage VD, and outputs the voltage waveform as the waveform signal P5, to the drive circuit 20. The drive circuit 20 receives the waveform signal P5, converts the waveform signal P5 to the driving voltage VD of a low impedance, outputs the driving voltage VD, and drives the ferroelectric liquid crystal panel 10 (step ST11: refer to FIG. 1).

Here, the D/A circuit 31*a* of the waveform generation circuit 30 described above generates the first voltage V1 and the D/A circuit 31*b* of the waveform generation circuit 30 generates the second voltage V2. Further, the inverter circuits 34*a*, 34*b* of the waveform generation circuit 30 described above respectively generate the first voltage V3 and the second voltage V4, which are negative voltages. The timing generator circuit 33 of the waveform generation circuit 30 generates the pulse widths PW1, PW2, and PW3, PW4 (refer to FIG. 2).

The control hereafter involves returning to step ST6 from step ST11, recursively executing step ST6 to step ST11, and varying V1, V2, V3, and V4 according to temperature changes measured by the temperature sensor 60, whereby the response speed S and switching angle θ that achieve the required performance can be maintained stably with respect to temperature.

Figure 8A:
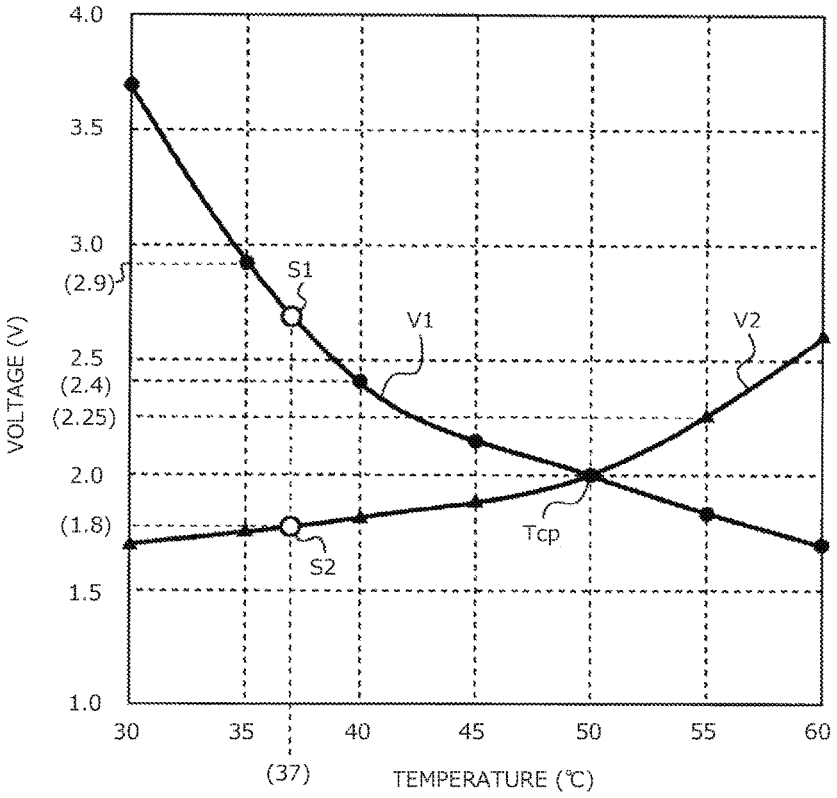
FIG. 8A is a table and graph of a first voltage and a second voltage of the driving voltage of the embodiment according to the present invention.
Figure 8B:
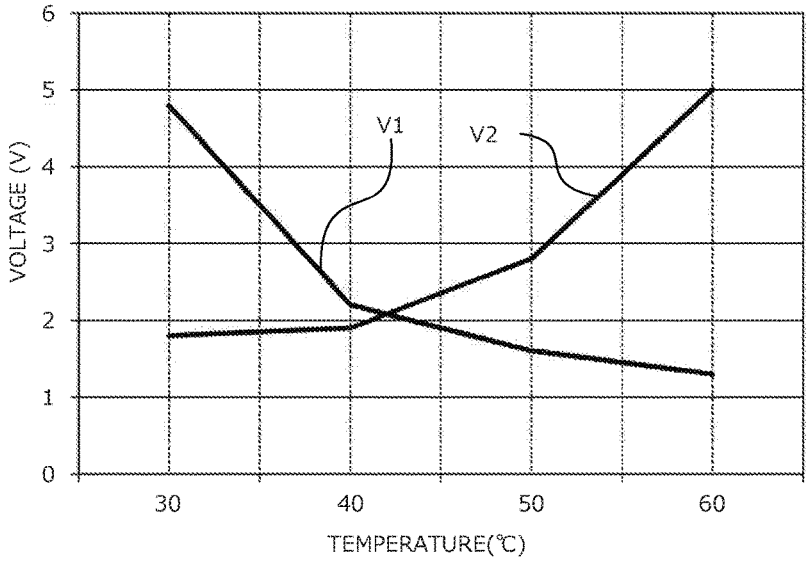
FIG. 8B is a table and graph of the first voltage and the second voltage of the driving voltage of the embodiment according to the present invention.

[Detailed Description of Table Generation: FIG. 8A, FIG. 8B]

Details of the generation of the table of the first voltage V1 and the second voltage V2 at step ST4 in the flowchart described above (refer to FIG. 7) will be described with reference to primarily FIG. 8A and FIG. 8B.

FIG. 8A depicts a table of a first voltage and a second voltage of the driving voltage in the case (corresponds to FIG. 3A, FIG. 4A) of a material whereby the birefringence anisotropy of the ferroelectric liquid crystal panel 10 is 0.247. FIG. 8B depicts a table of the first voltage and the second voltage of the driving voltage in the case (corresponds to FIG. 3B, FIG. 4B) of a material whereby the birefringence anisotropy of the ferroelectric liquid crystal panel 10 is 0.159.

Hereinafter, although the case (corresponds to FIG. 3A, FIG. 4A, FIG. 8A) of a material whereby the birefringence anisotropy of the ferroelectric liquid crystal panel 10 is 0.247 will be described primarily, the same holds for the case (corresponds to FIG. 3B, FIG. 4B, FIG. 8B) whereby the birefringence anisotropy of the ferroelectric liquid crystal panel 10 is 0.159.

The control circuit 40 of the liquid crystal apparatus 1 extracts necessary data from among the temperature characteristics and voltage characteristics of the response speed S (FIG. 3A: Table 1-1) stored in the memory circuit 50. For example, in a case where the operating range of the liquid crystal apparatus 1 is assumed to be 30° C. to 60° C. and the required value of the response speed S is assumed to be 120 μsec, the data of driving voltages of 1.5V to 4V centered on the response speed S of 120 μsec over the temperature range of 30° C. to 60° C. are extracted and stored. The extracted data of the response speed S correspond to the table described above and depicted in (a-1) of FIG. 4A.

The control circuit 40 calculates from the extracted data of the response speed S ((a-1) of FIG. 4A), the voltage at which the response speed S becomes the required value of 120 μsec (indicated by the dot-and-dash line in (a-1) of FIG. 4A) at each temperature step of temperatures 30° C. to 60° C. and stores these as the first voltage V1 in Table T1 depicted in (a-1) of FIG. 8A. The required value of the response speed S=120 μsec is one example and is not limited hereto.

The control circuit 40 extracts the necessary data from among the temperature characteristics and voltage characteristics of the switching angle θ (FIG. 3A: Table 2-1) stored in the memory circuit 50. For example, in a case where the operating range of the liquid crystal apparatus 1 is assumed to be 30° C. to 60° C. and the required value of the switching angle θ is assumed to be 45 degrees, the data of driving voltages 1.5V to 5V centered on the switching angle θ of 45 degrees over the temperature range of 30° C. to 60° C. are extracted and stored. The extracted data of the switching angle θ correspond to the graph described above and depicted in (b-1) of FIG. 4A.

The control circuit 40 calculates from the extracted data of the switching angle θ ((b-1) of FIG. 4A), the voltage at which the switching angle θ becomes the required value of 45 degrees (indicated by the dot-and-dash line in (b-1) of FIG. 4A) at each temperature step of temperatures 30° C. to 60° C. and stores these as the second voltage V2 in Table T1 depicted in (a-1) of FIG. 8A.

Since the temperature step of Table T1 is coarse when 10° C., the control circuit 40 supplements the first voltage V1 and the second voltage V2 for the temperatures therebetween by computation by an arbitrary step and generates Table T2. Here, as one example, supplementation is performed at 35° C., 45° C., and 55° C.; and Table T2 of temperature steps of 5° C. within a temperature range of 30° C. to 60° C. is generated ((b-1) of FIG. 8A). In FIG. 8A, (b-1) depicts Table T2 in a graphical form to facilitate understanding.

Here, the first voltage V1 of Table T2 in (b-1) of FIG. 8A is a voltage value for maintaining the response speed S at 120 μsec and, when the temperature rises, the first voltage V1 has to be lowered. Furthermore, the second voltage V2 of Table T2 is a voltage value for maintaining the switching angle θ at 45 degrees and, when the temperature rises, the second voltage V2 has to be increased. At a temperature around 50° C., the first voltage V1 and the second voltage V2 become equivalent and cross. At temperatures exceeding this cross point, the magnitude of the first voltage V1 and the second voltage V2 are inverted. Here, the temperature at which the first voltage V1 and the second voltage V2 cross is defined as the cross temperature Tcp. The cross temperature Tcp is used in the determination made at step ST7 (refer to FIG. 7) in the flowchart described above.

In a case where even more precise control with respect to temperature is to be performed, the temperature step of Table T2 may be further refined, however, in this case, the measurement data depicted in Table 1-1 and Table 2-1 in FIG. 3A may be obtained at even smaller temperature steps and reflected in the temperature step of Table T2, the points at which supplementation is performed may be increased to refine temperature step of Table T2 without changing the temperature step of the measurement data in Table 1-1 and Table 2-1, for example. Further, configuration may be such that the tables are generated by a non-depicted external apparatus, not internally by the liquid crystal apparatus 1 and the liquid crystal apparatus 1 reads in the tables.

[Description of PW1, PW2 Determination]

Determination of the pulse width PW1 of the first interval and of the pulse width PW2 of the second interval at step ST5 in the flowchart (refer to FIG. 7) described above will be described. Here, the pulse width PW1 is preferably set according to the response speed S required of the ferroelectric liquid crystal panel 10 and the pulse width PW1 is assumed to be equal to the response speed S or the response speed S+α. Here, +α suffices to be about 0.5 times the response speed S at most and accordingly, in a case where the required response speed S is 120 μsec, the pulse width PW1 of the first interval is preferably a range of 120 to 180 μsec. The response speed S of the ferroelectric liquid crystal panel 10 suffices to be defined as the time consumed for the optical transmissivity L (refer to FIG. 5) to rise from 0% to 90%.

Further, the pulse width PW2 of the second interval is determined by the interval of the first frame-PW1 and as described above, setting is performed such that PW1=PW3, PW2=PW4 and therefore, if the pulse widths PW1, PW2 are determined, the pulse widths PW3, PW4 are also automatically determined.

Here, as one example, the interval of the first frame is assumed to be 10 msec, and the first interval pulse width PW1=140 μsec is assumed. In this case, the pulse width PW2 of second interval is 10 msec-140 μsec=9.86 msec.

Thus, the pulse widths PW1 to PW4 are determined by the frame interval and the response speed S required of the ferroelectric liquid crystal panel 10.

[Description of Determination of V1, V2 when Measured Temperature is less than Cross Temperature Tcp: FIG. 7, FIG. 8A]

Details of the determination of the first voltage V1 and the second voltage V2 at steps ST8, ST9 executed when the measured temperature is less than the cross temperature Tcp, at step ST7 in the flowchart (refer to FIG. 7) described above will be described.

Here, as one example, in a case where the measured temperature is 37° C., at step ST7 in the flowchart, the measured temperature is determined to be less than the cross temperature Tcp and the control proceeds to step ST8. Subsequently, at step ST8, the control circuit 40 uses the measured temperature to refer to Table T2 and determine the first voltage V1, however, if the measured temperature is between temperature steps of Table T2, the first voltage V1 suffices to employ the voltage value of the first voltage V1 of the temperature step on the side lower than the measured temperature.

More specifically, the control circuit 40 refers to Table T2, determines that the measured temperature of 37° C. (white circle S1 in (b-1) of FIG. 8A) is between the 35° C. temperature step and the 40° C. temperature step, and employs the value of the first voltage V1 at 35° C., which is the low side temperature step, i.e., employs the first voltage V1=2.9V. This is because if the first voltage V1 of the low side temperature step is employed, the first voltage V1 is selected on the high side and the response speed S is set to a speed faster than the required value, however, there is no problem with the amount by which the response speed S is faster than the required value. The first voltage V3 of the second frame is −2.9V.

Further, as another example, in a case where the measured temperature is 40° C., at step ST7 in the flowchart, the measured temperature is determined to be less than the cross temperature Tcp and the control proceeds to step ST8. Subsequently, at step ST8, the control circuit 40 refers to Table T2, determines that the measured temperature of 40° C. coincides with the 40° C. temperature step, and employs the first voltage V1=2.4V that corresponds to the 40° C. temperature step (refer to (b-1) of FIG. 8A). The first voltage V3 of the second frame is −2.4V.

Thus, at step ST8, when a measured temperature is between temperature steps of Table T2, as the first voltage V1, which determines the response speed S, the voltage value of the first voltage V1 that corresponds to the temperature step on the side lower than the measured temperature is employed; and when the measured value coincides with a temperature step of Table T2, the value of the first voltage V1 that corresponds to the temperature step is employed.

Subsequently, at step ST9, when the measured value is between temperature steps of Table T2, as the second voltage V2, which determines the switching angle θ, the control circuit 40 suffices to supplement and calculate the second voltage V2 corresponding to the measured temperature and determine the second voltage V2.

More specifically, when the measured temperature is 37° C., the control circuit 40 refers to Table T2 and determines that the measured temperature of 37° C. is between the 35° C. temperature step and the 40° C. temperature step (white circle S2 in (b-1) of FIG. 8A), supplements the second voltage V2 therebetween by computation according to the measured temperature and in this case, employs the second voltage V2=1.8V. This is because it is desirable for the switching angle θ to be as close to the required angle (i.e., 45 degrees) as possible and therefore, preferable to reflect any change in the measured temperature on the second voltage V2. The second voltage V4 of the second frame is −1.8V.

Further, when the measured temperature coincides with a temperature step of Table T2, as might be expected, no supplementation is necessary and it suffices to employ the voltage value of the second voltage V2 that corresponds to the temperature step.

[Description of Determination of V1, V2 Greater than or Equal to Cross Temperature Tcp: FIG. 7, FIG. 8A]

Details of the determination of the first voltage V1 and the second voltage V2 at step ST10 executed when the measured temperature is greater than or equal to the cross temperature Tcp at step ST7 in the flowchart (refer to FIG. 7) described above. Here, when the measured temperature is greater than or equal to the cross temperature Tcp, it suffices to refer to Table T2; determine the second voltage V2, which determines the switching angle θ; and set the first voltage V1, which determines the response speed S to a voltage value equal to that of the second voltage V2.

Here, as one example, when the measured temperature is 55° C., at step ST7 in the flowchart, the measured temperature is determined to be greater than or equal to the cross temperature Tcp and the control proceeds to step ST10. Subsequently, at step ST10, the control circuit 40 refers to Table T2, determines that the measured temperature of 55° C. coincides with the 55° C. temperature step of Table T2, and employs the second voltage V2=2.25V that corresponds to the 55° C. temperature step (refer to (b-1) of FIG. 8A). The first voltage V1 is set to be equivalent to the second voltage V2 and therefore, the first voltage V1=2.25V. For the second frame, the first voltage V3=the second voltage V4=−2.25V.

Further, when the measured temperature is between temperature steps of Table T2, similar to a case where the measured temperature is less than the cross temperature Tcp, the control circuit 40 supplements and determines the second voltage V2 by computation corresponding to the measured temperature and sets the first voltage V1 to be equivalent to the second voltage V2.

Figure 9:
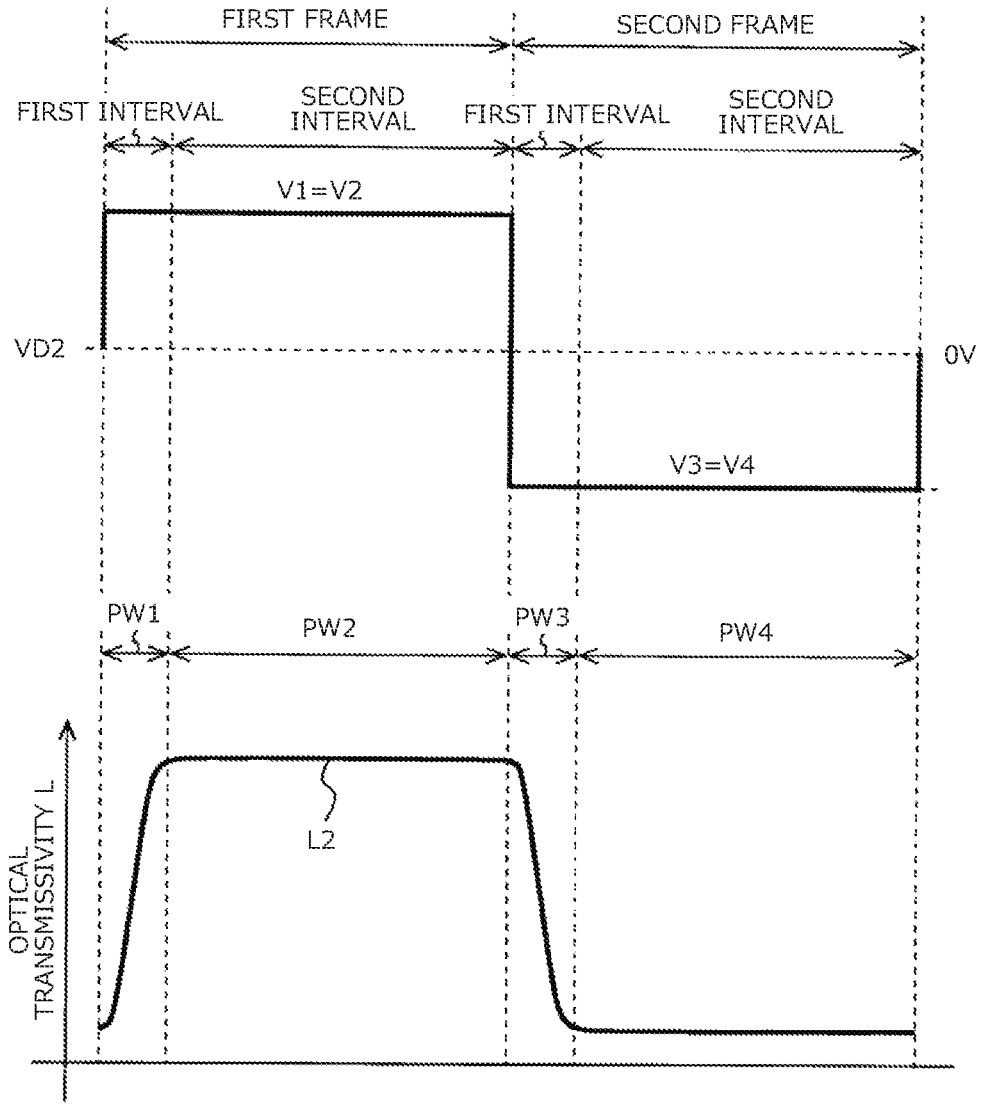
FIG. 9 is a diagram describing an example of a driving voltage VD2 for the cross temperature of the embodiment according to the present invention or greater, and an example of the optical transmissivity of ferroelectric liquid crystal panel by the driving voltage.

[Description of Driving Voltage VD2 when Measured Temperature is Greater than or Equal to Cross Temperature Tcp: FIG. 9]

An example of the voltage waveform of the driving voltage VD2 in a case where the measured temperature is the cross temperature Tcp or greater will be described with reference to FIG. 9. In FIG. 9, the driving voltage VD2 has a rectangular waveform centered at 0V, where the first voltage V1=the second voltage V2 and the first voltage V3=the second voltage V4.

Here, when the measured temperature is the cross temperature Tcp or greater, the reason for setting the first voltage V1=the second voltage V2 and the first voltage V3=the second voltage V4 is because, according to Table T2 (refer to (b-1) of FIG. 8A), in the temperature region that exceeds the cross temperature Tcp, although the response speed S can maintain the required speed when the first voltages V1, V3 are set to be lower than the second voltages V2, V4, the response speed S of the ferroelectric liquid crystal panel becoming faster than the required value rarely poses a problem.

Accordingly, in the temperature region that exceeds the cross temperature Tcp, the first voltages V1, V3 are set to be equal to the second voltages V2, V4, and even if the first voltages V1, V3 increase together with the second voltages V2, V4 accompanying temperature increases, no problem arises. Furthermore, by setting the first voltages V1, V3 to be equal to the second voltages V2, V4, affords an advantage of simplifying a portion of the control of the waveform generation circuit 30.

[Description of Operation of Ferroelectric Liquid Crystal Panel 10 by Driving Voltage VD2: FIG. 9]

Operation of the ferroelectric liquid crystal panel 10 by the driving voltage VD2 will be described with reference to FIG. 9.

Here, operation (the optical transmissivity L2) of the ferroelectric liquid crystal panel 10 by the driving voltage VD2 is the same as the operation by the driving voltage VD1 described above. In other words, as depicted in FIG. 9, when the positive first voltage V1 is applied during the first interval of the first frame of the driving voltage VD2, the ferroelectric liquid crystal panel 10 enters the second state (transmission state (refer to (a) of FIG. 10) by the long axis direction F of liquid crystal molecules) and the optical transmissivity L2 increases.

The slope of the rising curve at this time determines the response speed S of the ferroelectric liquid crystal. During the second interval after the first interval, the positive second voltage V2 of the same voltage value is applied and the long axis direction F of the liquid crystal molecules is maintained, whereby the second state (transmission state) continues and the high state of the optical transmissivity L2 continues.

When the first interval of the second frame begins, the negative first voltage V3 is applied whereby, the first state (non-transmission state (refer to (a) of FIG. 10) by the long axis direction E of liquid crystal molecules) begins and the optical transmissivity L2 rapidly drops. The slope of the descending curve at this time determines the response speed S of the ferroelectric liquid crystal. During the second interval after the first interval, the negative second voltage V4 of the same voltage value is applied and the long axis direction E of the liquid crystal molecules is maintained whereby, the first state (non-transmission state) continues and the low state of the optical transmissivity L2 continues.

Thus, even with operation (refer to FIG. 5) by the driving voltage VD1 of a temperature region lower than the cross temperature Tcp described above and with operation (refer to FIG. 9) by the driving voltage VD2 of a temperature region higher than the cross temperature Tcp, operation (transition of optical transmissivities L1 and L2) of the ferroelectric liquid crystal panel 10 is substantially the same. This is because the liquid crystal apparatus of the present invention corrects the temperature dependency of the ferroelectric liquid crystal panel 10 by the driving voltage and obtains the response speed S and the switching angle θ that are stable and resistant to the effects of temperature changes.

When the response speed S maintains the required speed, even in a temperature region that exceeds the cross temperature Tcp, although not depicted, it suffices to perform control that omits step ST7 depicted in the flowchart in FIG. 7; execute steps ST8 and ST9 normally; refer to Table T2; and determine the first voltage V1 and the second voltage V2. In this case, as indicated in Table T2 (refer to (b-1) of FIG. 8A), in a region in which the measured temperature exceeds the cross temperature Tcp, the first voltages V1, V3 are voltage values that are lower than those of the second voltages V2, V4.

Here, in a temperature region that exceeds the cross temperature Tcp, by setting the first voltages V1, V3 to low voltage values according to Table T2 such that the response speed S maintains the required speed, i.e., the response speed S is not faster than required, an effect of suppressing the occurrence of orientation deformation of the ferroelectric liquid crystal in the high-temperature region can be expected.

As described, the liquid crystal apparatus of the present invention can vary respectively according to temperature, the first voltages V1, V3 and the second voltages V2, V4 of the driving voltage to correct the temperature dependency of the ferroelectric liquid crystal panel and thereby, can provide a liquid crystal apparatus that is equipped with a ferroelectric liquid crystal panel that has a fast response speed and optimal switching angle, and achieves the required performance with respect to temperature changes. Further, by adjusting the driving voltage according to the required response speed and switching angle, high voltage exceeding that which is necessary is not applied to the ferroelectric liquid crystal panel and therefore, the occurrence of orientation deformation of the ferroelectric liquid crystal is prevented, enabling a liquid crystal apparatus of high precision and high quality to be provided.

The block diagrams, flowcharts, etc. depicted in the embodiments of the present invention do not limit the invention, which includes modifications that fall fairly within the basic teaching herein.

INDUSTRIAL APPLICABILITY

The liquid crystal apparatus according to the present invention corrects the temperature dependency of a ferroelectric liquid crystal panel and achieves the realization of stable operation with respect to temperature changes, enabling wide use in applications requiring high-speed response such as laser projectors and liquid crystal shutters.

EXPLANATIONS OF LETTERS OR NUMERALS

1 liquid crystal apparatus
10 ferroelectric liquid crystal panel
20 drive circuit
30 waveform generation circuit
31*a*, 31*b* digital-to-analog converter circuit (D/A circuit)
32 reference power source
33 timing generator circuit
34*a*, 34*b* inverter circuit
35 switch circuit
40 control circuit
50 memory circuit
60 temperature sensor
70 input circuit
P1 input signal
P2 temperature signal
P3 memory signal
P4 control signal
P5 waveform signal
VD, VD1, VD2 driving voltage

The invention claimed is:

1. A liquid crystal apparatus having a liquid crystal panel that uses a ferroelectric liquid crystal, a drive circuit that supplies driving voltage to the liquid crystal panel, a waveform generation circuit that supplies a waveform signal to the drive circuit, and a control circuit that controls the waveform generation circuit, the liquid crystal apparatus comprising a sensor that measures ambient temperature, wherein the drive circuit, in a first frame of the driving voltage, outputs during a first interval, a first voltage that is positive and outputs during a second interval that is longer than the first interval, a second voltage that is positive, the drive circuit, in a second frame, outputs during the first interval, the first voltage that is negative and outputs during the second interval that is longer than the first interval, the second voltage that is negative, the control circuit varies the first voltage and the second voltage according to a temperature measured by the sensor, the control circuit generates from temperature characteristics of a response speed of the liquid crystal panel and of a switching angle of the ferroelectric liquid crystal, a table of the first voltage and the second voltage for obtaining a given response speed and switching angle, refers to the table according to the measured temperature, and determines the first voltage and the second voltage, and the table is structured having values of the first voltage and the second voltage at a given temperature step, and in a temperature region lower than a temperature at which the first voltage and the second voltage determined by the table become equivalent, when the measured temperature is between temperature steps of the table, a voltage value of a temperature step on a low temperature side is selected as the first voltage, and a voltage that corresponds to the measured temperature is employed as the second voltage.

2. The liquid crystal apparatus according to claim 1, wherein the table is structured having values of the first voltage and the second voltage at a given temperature step, and in a temperature region higher than a temperature at which the first voltage and the second voltage determined by the table become equivalent, a voltage that corresponds to the measure temperature is employed as the second voltage and the first voltage is set to a voltage value equivalent to the second voltage.

3. The liquid crystal apparatus according to claim 1, wherein a pulse width of the first interval of the first frame and the second frame, respectively, is determined according to a response speed of the liquid crystal panel.

4. The liquid crystal apparatus according to claim 2, wherein a pulse width of the first interval of the first frame and the second frame, respectively, is determined according to a response speed of the liquid crystal panel.

* * * * *